US005887297A

United States Patent [19]

Sutor

[11] Patent Number: 5,887,297

[45] Date of Patent: Mar. 30, 1999

[54] BATH TUB SHOWER ADJUSTABLE SEAT

[76] Inventor: Sebastian Sutor, 4050 N. Keystone Ave., Apt. 3-W, Chicago, Ill. 60641

[21] Appl. No.: 854,255

[22] Filed: May 9, 1997

[51] Int. Cl.[6] ..... A47K 3/12

[52] U.S. Cl. ..... 4/578.1; 4/571.1

[58] Field of Search ..... 4/560.1, 571.1, 4/573.1, 578.1, 579, 611

[56] References Cited

U.S. PATENT DOCUMENTS

| | | | |
|---|---|---|---|
| 2,648,849 | 8/1953 | Webb et al. | 4/560.1 |
| 3,595,224 | 7/1971 | Walter | 4/573.1 |
| 4,150,445 | 4/1979 | Bailey | 4/579 X |
| 4,166,297 | 9/1979 | Saleeby | 4/578.1 |
| 5,373,591 | 12/1994 | Myers | 4/560.1 |

*Primary Examiner*—Robert M. Fetsuga

[57] ABSTRACT

A bath tub shower adjustable seat including a seat and a support frame. The support frame includes at least one member with a length that is adjustable. A side portion is coupled to a first end of the member for resting upon a side edge of a bath tub. A coupling mechanism is connected to a second end of the member and is adapted to maintain the second end of the member at an elevation equal to that of the first end thereof. In use, the lower portion of the seat is coupled to a central extent of the member and the support frame resides entirely in a spaced and elevated orientation with respect to a bottom of the bath tub.

1 Claim, 2 Drawing Sheets

BATH TUB SHOWER ADJUSTABLE SEAT

BACKGROUND OF THE INVENTION

1. Field of the Invention

The present invention relates to a bath tub shower adjustable seat and more particularly pertains to allowing a tub shower seat to be utilized on any one of a variety of shower tubs.

2. Description of the Prior Art

The use of tub shower seats is known in the prior art. More specifically, tub shower seats heretofore devised and utilized for the purpose of allowing one to sit during a shower are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,472,844 to Mace; U.S. Pat. No. 4,100,628 to Franzl; U.S. Pat. Des. No. 360,024 to Smith; U.S. Pat. No. 5,390,378 to Janisch; U.S. Pat. No. 5,097,542 to Roesler; and U.S. Pat. No. 4,166,297 to Saleeby.

In this respect, the bath tub shower adjustable seat according to the present invention substantially departs from the conventional concepts and designs of the prior art, and in so doing provides an apparatus primarily developed for the purpose of allowing a tub shower seat to be utilized on any one of a variety of shower tubs.

Therefore, it can be appreciated that there exists a continuing need for a new and improved bath tub shower adjustable seat which can be used for allowing a tub shower seat to be utilized on any one of a variety of shower tubs. In this regard, the present invention substantially fulfills this need.

SUMMARY OF THE INVENTION

In view of the foregoing disadvantages inherent in the known types of tub shower seats now present in the prior art, the present invention provides an improved bath tub shower adjustable seat. As such, the general purpose of the present invention, which will be described subsequently in greater detail, is to provide a new and improved bath tub shower adjustable seat which has all the advantages of the prior art and none of the disadvantages.

To attain this, the present invention essentially comprises a seat having an upper portion and a lower portion. The upper portion of the seat has a square configuration and resides within a vertical plane. The upper portion of the seat includes a pair of handles integrally coupled to side edges of the upper portion at an upper extent thereof. As best shown in FIG. 1, the handles reside within a plane in which the upper portion of the seat resides. The upper portion of the seat further has a pair of spaced and parallel posts depending from a lower edge thereof. With continuing reference to FIG. 1, it can be seen that a front surface of the upper portion of the seat has a vertical channel formed therein. Similar to the upper portion, the lower portion of the seat has a square configuration. The lower portion includes a pair of U-shaped brackets coupled to a rear edge thereof for slidably receiving the posts of the upper portion thereby maintaining the lower portion and upper portion of the seat in a perpendicular relative orientation. As shown in FIG. 2, a support frame includes a pair of spaced and parallel members each with a length that is adjustable. A side portion includes a bar coupled between first ends of the spaced and parallel members. Next provided is a pair of inverted generally U-shaped bath tub engagement portions integrally coupled to ends of the bar of the side portion for resting upon a side edge of a bath tub. For allowing for maximum stability, the bar of the side portion is adjustable along an axis which is perpendicular to the spaced and parallel members. Also included is a coupling means adapted to maintain second ends of the spaced and parallel members at an elevation equal to that of the first ends thereof. A pair of inverted U-shaped handles are included. Such handles consist of a first handle having ends thereof integrally coupled to the bar of the side portion of the support frame and a second handle having ends thereof integrally coupled between the spaced and parallel members adjacent the second end thereof. As shown in the Figures, each handle has an elastomeric grip formed thereon. Further, the handles reside in separate planes that are parallel. Finally, a plurality of brackets are adapted to couple a lower surface of the lower portion of the seat to a central extent of the spaced and parallel members between the handles of the frame. When the present invention is in its operative orientation, a plane in which the upper portion of the seat resides is perpendicular with respect to the planes associated with the handles.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bath tub shower adjustable seat which has all the advantages of the prior art tub shower seats and none of the disadvantages.

It is another object of the present invention to provide a new and improved bath tub shower adjustable seat which may be easily and efficiently manufactured and marketed.

It is a further object of the present invention to provide a new and improved bath tub shower adjustable seat which is of a durable and reliable construction.

An even further object of the present invention is to provide a new and improved bath tub shower adjustable seat which is susceptible of a low cost of manufacture with regard to both materials and labor, and which accordingly is then susceptible of low prices of sale to the consuming public, thereby making such bath tub shower adjustable seat economically available to the buying public.

Still yet another object of the present invention is to provide a new and improved bath tub shower adjustable seat which provides in the apparatuses and methods of the prior art some of the advantages thereof, while simultaneously overcoming some of the disadvantages normally associated therewith.

Still another object of the present invention is to allow a tub shower seat to be utilized on any one of a variety of shower tubs.

Lastly, it is an object of the present invention to provide a new and improved bath tub shower adjustable seat including a seat and a support frame. The support frame includes at least one member with a length that is adjustable. A side portion is coupled to a first end of the member for resting upon a side edge of a bath tub. A coupling mechanism is connected to a second end of the member and is adapted to maintain the second end of the member at an elevation equal to that of the first end thereof. In use, the lower portion of the seat is coupled to a central extent of the member and the support frame resides entirely in a spaced and elevated orientation with respect to a bottom of the bath tub.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
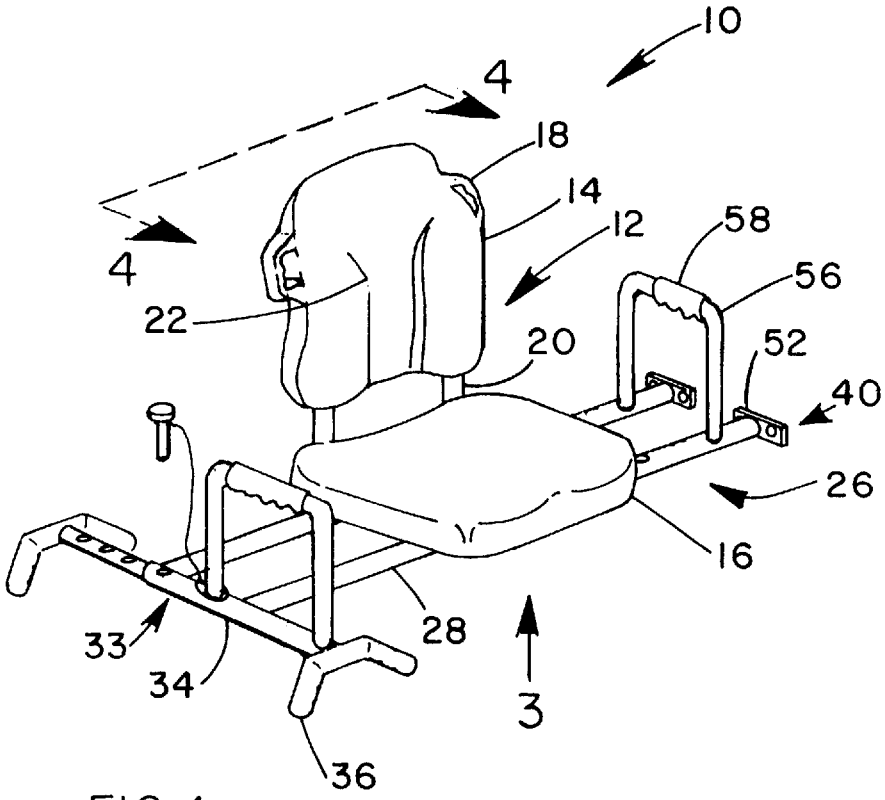
FIG 1 is a perspective illustration of the preferred embodiment of the bath tub shower adjustable seat constructed in accordance with the principles of the present invention.

With reference now to the drawings, and in particular to FIG. 1 thereof, a new and improved bath tub shower adjustable seat embodying the principles and concepts of the present invention and generally designated by the reference numeral 10 will be described.

The present invention, the new and improved bath tub shower adjustable seat, is comprised of a plurality of components. Such components in their broadest context include a seat and a support frame. Such components are individually configured and correlated with respect to each other so as to attain the desired objective.

Figure 4:
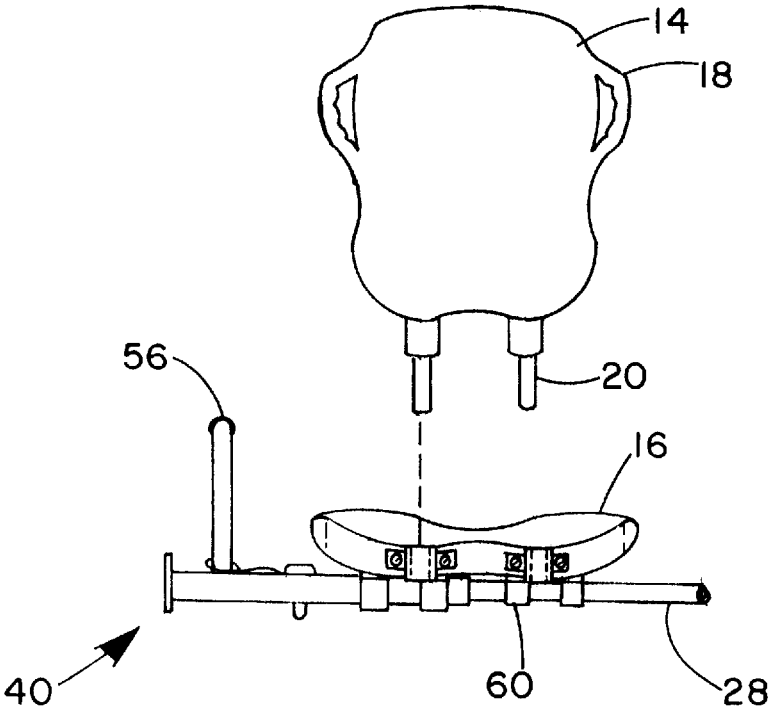
FIG. 4 is a rear view of the present invention.

More specifically, it will be noted that the system 10 of the present invention includes a seat 12 having an upper portion 14 and a lower portion 16. The upper portion of the seat has a square configuration and resides within a vertical plane. The upper portion of the seat includes a pair of handles 18 integrally coupled to side edges of the upper portion at an upper extent thereof. As can best be seen in FIG. 4, the handles are closed loops and have undulations formed along an inner edge thereof. As shown in FIG. 1, the handles reside within a plane in which the upper portion of the seat resides. The upper portion of the seat further has a pair of spaced and parallel posts 20 depending from a lower edge thereof. With continuing reference to FIG. 1, it can be seen that a front surface of the upper portion of the seat has a vertical channel 22 formed therein. Similar to the upper portion, the lower portion of the seat has a square configuration. The lower portion includes a pair of U-shaped brackets 24 coupled to a rear edge thereof for slidably receiving the posts of the upper portion thereby maintaining the lower portion and upper portion of the seat in a perpendicular relative orientation. It should be noted that the posts frictionally engage the brackets for affording a secure fit.

Figure 2:
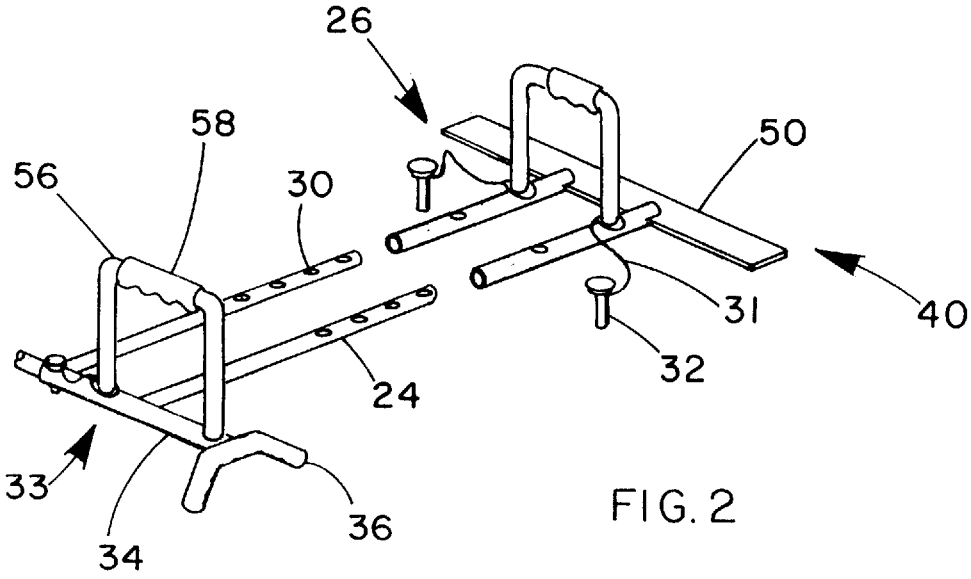
FIG. 2 is a perspective view of the frame shown in FIG. 1.

As shown in FIG. 2, a support frame 26 includes a pair of spaced and parallel members 28 each with a length that is adjustable. To accomplish such adjustability, each of the members comprise of a pair of tubes that are slidably engaged with respect to each other. A plurality of holes 30 are formed thereon for allowing the selective fixing of the length by means of a set pin 32. Such pins are secured to the frame by means of a string 31. A side portion 33 includes a bar 34 coupled between first ends of the spaced and parallel members. Next provided is a pair of inverted generally U-shaped bath tub engagement portions 36 integrally coupled to ends of the bar of the side portion for resting upon a side edge of a bath tub. For allowing for maximum stability, the bar of the side portion is adjustable along an axis which is perpendicular to the spaced and parallel members. Similar to the spaced and parallel members, the bar of the side portion consists of a pair of tubes that are slidably engaged with respect to each other. A plurality of holes are formed in such tubes for allowing the selective fixing of the length by means of a another set pin. It should be noted that only one of the aforementioned tubes of the bar is coupled to the first ends of the spaced and parallel members. The remaining tube is telescopically extend rearwardly with respect to the seat, as will be seen later.

Figure 3:
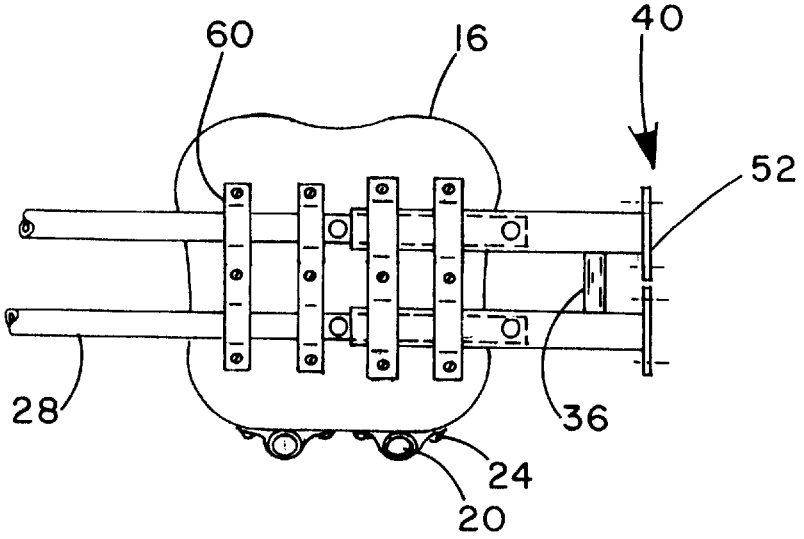
FIG. 3 is a bottom view of the present invention.

Also included as a component of the support frame is a coupling means 40 adapted to maintain second ends of the spaced and parallel members at an elevation equal to that of the first ends thereof. In a first embodiment, the coupling means comprises a plate 50 for resting on a side of the bath tub. Note FIG. 2. Such plate preferably is elongated and resides in a horizontal plane. As shown in FIG. 2, the plate extends forwardly and rearwardly an equal length with respect to the spaced and parallel members. In an alternate embodiment, the coupling means comprises a pair of plates 52 coupled to each separate second end of the spaced and parallel members. Apertures are formed therein for receiving screws for screwably coupling with a wall adjacent the bath tub. See FIGS. 1, 3, & 4.

Next provided is a pair of inverted U-shaped handles 56. Such handles consist of a first handle having ends thereof integrally coupled to the bar of the side portion of the support frame and a second handle having ends thereof integrally coupled between the spaced and parallel members adjacent the second end thereof. As shown in the Figures, each handle has an elastomeric grip 58 formed thereon. Further, the handles reside in separate planes that are parallel. Finally, a plurality of brackets 60 are adapted to couple a lower surface of the lower portion of the seat to a central extent of the spaced and parallel members between the handles of the frame. Preferably, the brackets attach the seat to both set of tubes of each of the spaced and parallel members. It should be noted that the coupling of one set of tubes is slidable in nature such that the length of the spaced and parallel members may be adjusted while the seat is attached. When the present invention is in its operative orientation, a plane in which the upper portion of the seat resides is perpendicular with respect to the planes associated with the handles. Further, the support frame resides entirely in a spaced and elevated orientation with respect to a bottom of the bath tub.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bath tub shower adjustable seat comprising, in combination:

a seat having an upper portion and a lower portion, the upper portion of the seat having a square configuration, the upper portion of the seat including a pair of handles integrally coupled to side edges of the upper portion at an upper extent thereof, the upper portion of the seat further having a pair of spaced and parallel posts depending from a lower edge thereof and a front surface with a vertical channel formed therein, the lower portion of the seat having a square configuration, the lower portion including a pair of U-shaped brackets coupled to a rear edge thereof for slidably receiving the posts of the upper portion thereby maintaining the lower portion and upper portion of the seat in a perpendicular relative orientation;

a support frame including a pair of spaced and parallel members each with a length that is adjustable, a side portion including a bar coupled between first ends of the spaced and parallel members and a pair of inverted generally U-shaped bath tub engagement portions integrally coupled to ends of the bar of the side portion for resting upon a side edge of a bath tub wherein the bar of the side portion is adjustable along an axis which is perpendicular to the spaced and parallel members, a coupling means adapted to maintain second ends of the spaced and parallel members at an elevation equal to that of the first ends thereof, a pair of inverted U-shaped handles including a first handle having ends thereof integrally coupled to the bar of the side portion of the support frame and a second handle having ends thereof integrally coupled between the spaced and parallel members adjacent the second end thereof wherein each handle has an elastomeric grip formed thereon, and a plurality of brackets adapted to couple a lower surface of the lower portion of the seat to a central extent of the spaced and parallel members between the handles of the frame.

* * * * *